US005293923A

United States Patent [19]

Alabi

[11] Patent Number: 5,293,923

[45] Date of Patent: Mar. 15, 1994

[54] PROCESS FOR METALLURGICALLY BONDING ALUMINUM-BASE INSERTS WITHIN AN ALUMINUM CASTING

[76] Inventor: Muftau M. Alabi, 100 Valleybrook La., East Amherst, N.Y. 14051

[21] Appl. No.: 912,342

[22] Filed: Jul. 13, 1992

[51] Int. Cl.[5] ..... B22D 19/00

[52] U.S. Cl. ..... 164/102; 164/100; 164/98

[58] Field of Search ..... 164/91, 97, 98, 100, 164/101, 112, 102

[56] References Cited

U.S. PATENT DOCUMENTS

| | | | |
|---|---|---|---|
| 3,024,183 | 3/1962 | MacEwan | 164/112 |
| 3,480,465 | 11/1969 | Imabayashi | 164/91 |
| 3,604,104 | 9/1971 | Glasgow | 228/183 |
| 3,633,266 | 1/1972 | Taylor | 228/183 |
| 4,687,043 | 8/1987 | Weiss et al. | 164/97 |

FOREIGN PATENT DOCUMENTS

| | | | |
|---|---|---|---|
| 55-10369 | 1/1980 | Japan | 164/100 |
| 59-174266 | 10/1984 | Japan | 164/98 |
| 62-89564 | 4/1987 | Japan | 164/100 |
| 64-75161 | 3/1989 | Japan | 164/101 |

OTHER PUBLICATIONS

Metals Handbook, Desk Edition, ASM Dec. 1988, pp. 11-6, 30-74, 30-75.

Beck et al., "The Kinetics of the Oxidation of Al in Oxygen at High Temperature", Corrosion Science, (1967) vol. 7, pp. 1 through 22.

Ritchie et al., "Oxidation of a Dilute Aluminum Magnesium Alloy", [Source is undecipherable] (1971) vol. 3, No. 1, pp. 91 through 101.

*Primary Examiner*—Richard K. Seidel
*Assistant Examiner*—Rex E. Pelto
*Attorney, Agent, or Firm*—Gary M. Hartman; Domenica N. S. Hartman

[57] ABSTRACT

A method is provided for forming a metallurgical bond between an aluminum-base insert and an aluminum-base casting material during a casting process, wherein the method entails wetting the oxide surface of the insert, coating the surface with a metallurgically compatible material, and raising the temperature of the insert to reduce the temperature gradient between the insert and the casting material. The insert is dipped into a molten zinc-base alloy which includes about 2 to about 10 weight percent aluminum. The zinc-base alloy coats the insert and remains on the surface of the insert until a molten casting material is introduced. As a result, the surface of the coated insert is nearly oxide-free. The aluminum content in the zinc-base alloy is preferably about 4 to about 6 weight percent of the zinc-base alloy. The zinc-base alloy also preferably contains between about 0.25 and 0.35 weight percent magnesium for the purpose of weakening the oxide film layer on the insert. As a result, both the zinc-base alloy and the casting material can more readily wet the surface of the insert to achieve a good metallurgical bond therebetween. The residual zinc-base alloy layer fuses to the surface of the insert and the casting material. The method of the invention is equally applicable to magnesium-base alloys and composites.

20 Claims, No Drawings

PROCESS FOR METALLURGICALLY BONDING ALUMINUM-BASE INSERTS WITHIN AN ALUMINUM CASTING

The present invention generally relates to methods for obtaining a metallurgical bond between a casting insert and the cast material. More particularly, this invention relates to an improved process for creating a metallurgical bond between an aluminum-base composite or alloy insert, such as used for a cylinder wall of an internal combustion engine, and an aluminum cast body, wherein the metallurgical bond is characterized by high integrity.

BACKGROUND OF THE INVENTION

To improve the mechanical and physical properties of castings, it is well known in the art to use inserts which can locally improve the strength, wear resistance or other characteristics of the casting. The inserts are placed within the mold prior to pouring the molten casting material and, upon cooling of the molten casting material, the inserts form an integral part of the finished cast product. A common example of such an application is in the engine block of an internal combustion engine. In particular, aluminum alloy engine blocks, typically an aluminum-silicon alloy, often make use of cast iron inserts, or liners, which are more durable than the cast aluminum walls of the engine block, particularly when aluminum pistons are used. A process well known to those skilled in the art is referred to as the "Al-fin" process, which entails dipping a cast iron insert in molten aluminum prior to placing the insert in a mold and casting a molten aluminum around the insert.

However, a disadvantage with the use of cast iron liners is the significant additional weight which is incurred. In addition, cast iron does not conduct heat away from the cylinder as well as aluminum, which raises the temperature of the cylinder and imposes higher temperature-related stresses and wear on the engine's internal components. Another disadvantage with using iron is that there is a mismatch between coefficients of thermal expansion between iron and aluminum and its alloys, which can cause debonding of the insert.

As a result, it is generally preferable to provide inserts which are lower in weight while also providing better heat transfer capability and a more closely matched coefficient of thermal expansion. Naturally, aluminum-base alloys and composites are generally suitable in terms of weight, heat transfer and thermal expansion, for use with aluminum castings. Unfortunately, aluminum-base inserts do not metallurgically bond well to casting materials because the insert forms an aluminum oxide layer at the insert's surface. The presence of oxides produces a weak bond because of the inability of the molten casting material to wet the insert's surface.

To overcome this problem, one approach known in the art has been to form an insert which can be penetrated by the casting material under high pressure to form a mechanical/metallurgical bond between the casting material and the insert. One such approach uses alumina and carbon fibers which have been highly compressed to form a cylindrical insert. An aluminum casting material is then pressurized sufficiently during the casting process to penetrate the fiber inserts without structurally damaging them. While durability is improved, manufacturing costs are significantly higher than that of iron liners in aluminum blocks.

An approach for promoting a metallurgical bond between the insert and the casting material is taught by U.S. Pat. No. 4,687,043 to Weiss et al. Weiss et al. provide an aluminum composite insert whose outer surface is covered with an aluminum alloy. The insert is then coated with a molten solder alloy. The molten solder alloy is selected to have a melting temperature which is below the melting temperature of the insert's aluminum alloy cover layer. The insert is dipped into the molten solder alloy to separate from the cover layer the oxides already present and to prevent the formation of new oxides thereon. In addition, Weiss et al. teach that the casting material must be at a temperature which is higher than the melting temperatures of the insert's cover layer and the solder alloy. This enables the casting material to flush the molten solder alloy from the cover layer during the casting process to expose the cover layer to the casting material, allowing the casting material and the cover layer to form an oxide-free metallurgical bond. The molten solder alloy is intended to be mixed with the casting material and not remain on the surface of the insert.

In addition, Weiss et al. teach a zinc solder alloy which contains about 10 to 30 weight percent tin and about 5 to 25 weight percent cadmium to reduce the melting temperature of the solder alloy below the temperature of the casting mold. A disadvantage to the use of tin for the purposes taught by Weiss et al. is that tin embrittles the solder alloy and the interface between the insert and the casting, while also reducing their corrosion resistance. The presence of tin also slows down the age hardening by reducing the Guinier-Preston (GP) zones formation rate, potentially causing a weak interface between the insert and the casting. Similar to tin, cadmium reduces corrosion resistance. But most importantly, cadmium poses an environmental concern in that it is highly toxic. As a result, the use of cadmium is always avoided where possible, and sometimes prohibited.

Thus, it would be desirable to provide a method of promoting a metallurgical bond between a strong, wear-resistant insert and an aluminum alloy casting material which would be economical for use in mass production, while also avoiding the concerns for embrittlement and toxicity.

SUMMARY OF THE INVENTION

It is an object of this invention to provide a method for forming a strong metallurgical bond between an insert and a casting material so as to produce an integral casting having improved mechanical and physical properties in the region of the insert.

It is a further object of this invention that such a method be achieved by providing a coating material on the insert wherein the coating material becomes an integral constituent of the bond between the insert and the casting material.

It is still a further object of this invention that such a method be particularly suitable for molding an aluminum alloy or aluminum composite insert into an aluminum alloy casting such that the oxide layer on the insert is sufficiently wetted by the casting material to permit a good metallurgical bond to be formed.

In accordance with a preferred embodiment of this invention, these and other objects and advantages are accomplished as follows.

According to the present invention, there is provided a method for improving the formation of a metallurgical bond between an aluminum-base insert and an aluminum-base casting material. The aluminum-base insert can be formed from such materials as wrought aluminum alloys, castable aluminum alloys, and aluminum-base metal-matrix composites for the purpose of improving wear resistance and eliminating machining of hard materials in other sections of the casting, whereas the aluminum-base casting material can be any conventional aluminum alloy, such as aluminum-silicon casting alloys. As an important feature, the teachings of the present invention are equally applicable to magnesium-base materials, such as wrought magnesium alloys, castable magnesium alloys, and magnesium-base metal-matrix composites.

According to the present invention, prior to being placed in a mold and coming in contact with the casting material, the insert is dipped into a molten zinc-base alloy, including about 2 to about 10 weight percent aluminum, which promotes a metallurgical bond between the insert and the casting material. In addition, a magnesium content of between about 0.1 and 0.5 weight percent is also included in the zinc-base alloy to weaken any oxide film layer on the insert or the zinc-base alloy. More preferably, the magnesium content is held between about 0.25 and about 0.35 weight percent of the zinc-base alloy. The presence of magnesium enables the casting material to more readily wet the surface of the insert and thereby achieve a good metallurgical bond therebetween.

As a particular aspect of the invention, the zinc-base alloy remains on the surface of the insert during the casting process to reduce or eliminate oxidation of the insert. The zinc-base alloy forms only a slight oxide film, much less than that of an uncoated aluminum-base insert. As a result, the surface of the coated insert is nearly oxide-free.

The aluminum content in the zinc-base alloy serves to provide a low liquidus temperature for the zinc-base alloy, thereby avoiding any detrimental effects which high temperatures may have on the insert material. More preferably, the aluminum constitutes about 4 to about 6 weight percent of the zinc-base alloy, such that the zinc-base alloy is mostly a eutectic alloy having the lowest liquidus temperature possible for the zinc-base alloy while also having the benefit of transforming directly from liquid to solid.

The insert is preferably immersed in the molten zinc-base alloy so as to coat the insert and raise the insert's temperature to something above the liquidus temperature of the molten zinc-base alloy, but below the liquidus temperature of the insert. By raising the temperature of the insert, the insert is preheated sufficiently to reduce the temperature gradient between the insert and the molten casting material, minimizing contraction stresses and shrinkage after the casting has solidified.

The coated insert is then placed in a mold, and the casting material is introduced into the mold at a temperature above its melting temperature and the melting temperature of the zinc-base alloy. As a result, the coated insert metallurgically bonds with the casting material as the casting material is introduced into the mold. The residual zinc-base alloy layer fuses to the insert and the casting material.

Other objects and advantages of this invention will be better appreciated from the following detailed description.

DETAILED DESCRIPTION OF THE INVENTION

A method is provided for forming a metallurgical bond between an aluminum-base insert, such as an aluminum alloy or aluminum alloy composite insert, and a castable aluminum alloy during a casting process, such as die casting, squeeze casting and permanent mold casting processes, as well as others. The method is particularly suitable for metallurgically bonding aluminum alloy and aluminum alloy composite inserts, which improve localized mechanical and physical properties of an aluminum alloy casting, such as the cylinder walls and the piston ring grooves for a reciprocating engine. While the present invention will be discussed in detail in terms of aluminum-base materials, it will become clear to those skilled in the art that the teachings of the present invention are equally applicable to magnesium-base materials, such as wrought magnesium alloys, castable magnesium alloys, and magnesium-base metal-matrix composites. However, for purposes of clarity, the following discussion will focus on the use of aluminum-base materials only.

As a primary feature, the method of the present invention is able to minimize the effect of the oxides on the surfaces of the aluminum alloy and aluminum alloy composite inserts to a degree that promotes a good metallurgical bond between the insert and the casting alloy. As an added feature, the method entails preheating the inserts to reduce the temperature gradient between the insert and the molten casting alloy so as to reduce contraction stresses and shrinkage in the casting. As a result, a metallurgical bond is created between the aluminum-base inserts and the aluminum alloy casting with no defined bond line at the insert-casting interface.

The method includes immersing the insert in a zinc-base alloy to both raise the temperature of the insert and coat the insert with the zinc-base alloy, prior to positioning the insert within a mold and introducing the molten casting alloy into the mold. The zinc-base alloy may contain about 2 to about 10 weight percent aluminum, and about 0.1 to about 0.5 weight percent magnesium, with the balance being essentially zinc. More preferably, the aluminum content is held between about 4 and about 6 weight percent to provide a low liquidus temperature for the zinc-base alloy, and the magnesium content is held between about 0.25 and about 0.35 weight percent.

As a result, the properties of the zinc-base alloy include a casting temperature range of about 750° F. to about 850° F., and a liquidus temperature of about 728° F., which is significantly lower than the liquidus temperatures of any of the preferred aluminum alloy or aluminum alloy composite inserts or the aluminum casting alloy. This permits the inserts to be immersed in the zinc-base alloy during the coating process for long periods of time without any detrimental effect on the insert. As a practical minimum, most inserts would need to be immersed in the zinc-base alloy for about three minutes to sufficiently raise their temperature such that the temperature gradient is minimized, thereby reducing contraction stresses in the casting.

The zinc-base alloy also has the added benefit of having good thermal conductivity, about 65.3 Btu/ft.hr.°F., and a coefficient of thermal expansion of 15.2$\mu$ in/in.°F., which is closer to the coefficient of thermal expansion of the aluminum-base inserts and aluminum alloy casting (typically about 12.5μ in/in.°F.) than would be an iron insert (about 7μ in/in.°F.).

The magnesium content is included in the zinc-base alloy to weaken the aluminum and/or zinc oxide film layers which inherently form on the aluminum-base insert. The magnesium forms magnesium oxide (MgO) and spinel ($MgAl_2O_4$) which crack and weaken the aluminum and zinc oxide layers. As a result, both the zinc-base alloy and the aluminum casting alloy can more readily wet the surface of the insert to achieve a good metallurgical bond therebetween.

As an additional advantage, by coating the inserts with the zinc-base alloy, the surface of the coated insert will have a minimum of oxide layer because molten zinc forms oxides to a much lesser degree than aluminum. Therefore, wettability of the coated insert with the aluminum alloy casting material will be very high, and the insert will more readily bond with the casting material.

The preferred process of the present invention includes providing an insert which is suitably formed to serve as the structural or wear component of a casting. As previously noted, the insert can be formed from wrought aluminum alloys, castable aluminum alloys, and aluminum-base metal-matrix composites, such as an aluminum alloy which includes alumina or silicon carbide particles. Prior to positioning the insert within the mold, the insert is immersed in the zinc-base alloy which has been raised to a temperature above the zinc-base alloy's liquidus temperature, and more preferably, about 750° F. to about 850° F. to ensure that the molten zinc-base alloy will readily flow and adhere to the insert. The lower viscosity at the higher temperature also provides a thinner coating on the insert, which is preferably no more than about six millimeters.

The coated insert is then placed in the mold, and the aluminum casting alloy is introduced in a molten form into the mold at a temperature above the melting temperatures of the insert and the zinc-base alloy. As an example, aluminum-silicon casting alloys (eutectic and hypereutectic compositions) have a liquidus temperature of about 1040° F., and a melt holding temperature of about 1300° to about 1420° F. The higher melt holding temperature promotes flowability of the material into the mold. Because the molten aluminum casting alloy is at a temperature greater than the melting temperatures of the zinc-base alloy and the insert, the zinc-base alloy fuses with the insert and the molten aluminum casting alloy so as to metallurgically bond the insert with the aluminum alloy casting.

As a result, the zinc-base alloy layer sufficiently fuses with the insert and the aluminum casting alloy to obscure the interface between the insert and the aluminum casting alloy. The final cast article is then characterized by having one or more inserts which are metallurgically bonded to the casting such that better mechanical and physical properties are imparted locally at the site of the insert or inserts.

From the above, it can be seen that a particular advantage to the method of the present invention is that the preferred zinc-base alloy becomes an integral part of the cast article which serves to provide a good metallurgical bond between the insert and the casting alloy. The zinc-base alloy adheres well to the insert, in part due to the ability of the magnesium to weaken the aluminum and zinc oxide layers on the insert. As a result, the method of the present invention provides an economical and practical process for creating a strong bond between the insert and the casting.

In addition, the thermal conductivity of the zinc-base alloy is sufficiently high to be better able to conduct heat from the cylinder wall of an engine than an iron insert. Moreover, the better match in coefficient of thermal expansion reduces the potential for debonding of the insert during the life of the engine. Accordingly, the zinc-base alloy is sufficiently compatible with both the insert material and the casting alloy to remain an integral constituent of the cast article.

Another significant advantage with the method of the present invention is that, by immersing the insert in the molten zinc-base alloy, the insert is preheated to minimize the temperature gradient between the insert and the aluminum casting alloy during the casting process. The aluminum constituent of the zinc-base alloy lowers the liquidus temperature of the zinc-base alloy, thereby permitting the zinc-base alloy to be held at a sufficiently high temperature to minimize its viscosity. A lower viscosity produces a thinner coating on the insert, which is an economic advantage over the teachings of Weiss et al. in that it eliminates the need to brush or clean the insert of excess coating prior to positioning the insert within the mold.

In addition, the liquidus temperature of the zinc-base alloy is significantly lower than the liquidus temperatures of the preferred aluminum alloy or aluminum alloy composite inserts, and the aluminum alloy casting material. As a result, the inserts can be immersed in the zinc-base alloy for long periods of time without any detrimental effect on the insert, a feature which makes the process of the present invention particularly amenable to mass production conditions.

Finally, the teachings of this invention can be readily employed to metallurgically bond inserts and casting alloys which differ from the preferred materials above. As a primary example, the above teachings, though described in terms of aluminum-base materials, are equally applicable to magnesium-base alloys and composites. In addition, with only slight modifications the benefits of the preferred method can be realized with metal powders using powder metallurgy techniques.

Therefore, while our invention has been described in terms of a preferred embodiment, it is apparent that other forms could be adopted by one skilled in the art. For example, the processing parameters could be altered, such as the temperatures or durations employed, or by introducing appropriate elements in the zinc-base or aluminum-base alloys which would permit the use of different temperature ranges. Accordingly, the scope of our invention is to be limited only by the following claims.

I claim:

1. A method for forming a metallurgical bond between an aluminum-base or magnesium-base insert having an oxide film formed thereon and an aluminum-base or magnesium-base cast member, wherein said method comprises the steps of:

providing a molten zinc-base alloy consisting essentially of about 2 to about 10 weight percent aluminum and about 0.1 to about 0.5 weight percent magnesium, with the balance being essentially zinc;

immersing said insert in said molten zinc-base alloy so as to form a zinc-base coating on said surface of said insert, said insert being immersed in said molten zinc-base alloy for a predetermined length of time which is sufficient to raise said insert to a temperature which is above the liquidus temperature of said molten zinc-base alloy and below the liquidus temperature of said insert;

placing said insert in a mold; and introducing into said mold a molten casting material selected from the group consisting of aluminum-base and magnesium-base alloys, such that said zinc-base coating substantially remains between said insert and said molten casting material;

whereby said zinc-base coating sufficiently remains on said surface of said insert, such that said oxide film on said insert is weakened so as to promote a metallurgical bond between said insert, said zinc-base coating and said molten casting material.

2. A method for forming a metallurgical bond as recited in claim 1 wherein said molten zinc-base alloy comprises about 4 to about 6 weight percent aluminum and about 0.25 to about 0.35 weight percent magnesium, with the balance being essentially zinc.

3. A method for forming a metallurgical bond as recited in claim 1 wherein said molten zinc-base alloy is heated to a temperature of about 750° F. to about 850° F.

4. A method for forming a metallurgical bond as recited in claim 1 further comprising the step of cooling said molten casting material and said insert within said mold so as to form a composite alloy casting.

5. A method for forming a metallurgical bond as recited in claim 1 wherein said insert is selected from the group consisting of wrought aluminum alloys, castable aluminum alloys, aluminum-base metal-matrix composites, wrought magnesium alloys, castable magnesium alloys, and magnesium-base metal-matrix composites.

6. A method for forming a metallurgical bond as recited in claim 1 wherein said molten casting material is an aluminum-silicon alloy.

7. A method for forming a metallurgical bond as recited in claim 1 wherein said predetermined length of time is at least three minutes.

8. A method for forming a metallurgical bond between an aluminum-base or magnesium-base insert having an oxide film formed essentially everywhere thereon and an aluminum-base or magnesium-base cast member, wherein said method comprises the steps of:

providing a molten zinc-base alloy consisting essentially of about 4 to about 6 weight percent aluminum and about 0.25 to about 0.35 weight percent magnesium, with the balance being essentially zinc;

immersing said insert in said molten zinc-base alloy so as to coat said insert with said molten zinc-base alloy to form a coated insert, said insert being immersed in said molten zinc-base alloy for a predetermined length of time which is sufficient to raise said insert to a temperature which is above the liquidus temperature of said molten zinc-base alloy and below the liquidus temperature of said insert;

placing said coated insert in a mold; and introducing into said mold a molten casting material selected from the group consisting of aluminum-base and magnesium-base alloys, such that said molten zinc-base alloy substantially remains between said insert and said molten casting material;

whereby said zinc-base alloy sufficiently remains on said surface of said insert, such that said oxide film on said insert is substantially weakened so as to promote a metallurgical bond between said insert, said zinc-base alloy and said molten casting material.

9. A method for forming a metallurgical bond as recited in claim 8 wherein said molten zinc-base alloy is heated to a temperature of about 750° F. to about 850° F.

10. A method for forming a metallurgical bond as recited in claim 8 further comprising the step of cooling said molten casting material and said coated insert within said mold so as to form a composite alloy casting.

11. A method for forming a metallurgical bond as recited in claim 8 wherein said insert is selected from the group consisting of wrought aluminum alloys, castable aluminum alloys, aluminum-base metal-matrix composites, wrought magnesium alloys, castable magnesium alloys, and magnesium-base metal-matrix composites.

12. A method for forming a metallurgical bond as recited in claim 8 wherein said molten casting material is an aluminum-silicon alloy.

13. A method for forming a metallurgical bond as recited in claim 8 wherein said magnesium in said molten zinc-base alloy reacts with oxygen and oxides to form magnesium oxide or spinel while said insert is immersed in said molten zinc-base alloy.

14. A method for forming a metallurgical bond as recited in claim 8 wherein said predetermined length of time is at least three minutes.

15. A method for forming a metallurgical bond as recited in claim 8 wherein said molten zinc-base alloy deposits a layer on said insert having a thickness of no more than about six millimeters.

16. A method for forming a metallurgical bond between an aluminum-base insert with an oxide film formed thereon and an aluminum-base cast member, wherein said method comprises the steps of:

providing a molten zinc-base alloy consisting essentially of about 4 to about 6 weight percent aluminum and about 0.25 to about 0.35 weight percent magnesium, with the balance being essentially zinc;

immersing said aluminum-base insert in said molten zinc-base alloy so as to coat said aluminum-base insert with said molten zinc-base alloy to form a coated insert characterized by said oxide film being substantially weakened, said aluminum-base insert being immersed in said molten zinc-base alloy for a predetermined length of time which is sufficient to raise said aluminum-base insert to a temperature which is above the liquidus temperature of said molten zinc-base alloy and below the liquidus temperature of said aluminum-base insert;

placing said coated insert in a mold; and introducing into said mold a molten aluminum-base casting material such that said molten zinc-base alloy substantially remains between said insert and said molten aluminum-base coating material;

whereby said zinc-base alloy sufficiently remains on said surface of said insert, such that said oxide film is substantially weakened so as to promote a metallurgical bond between said insert, said zinc-base alloy and said molten aluminum-base casting material.

17. A method for forming a metallurgical bond between an aluminum-base insert and an aluminum-base cast member as recited in claim 16 wherein said molten zinc-base alloy is heated to a temperature of about 750° F. to about 850° F.

18. A method for forming a metallurgical bond between an aluminum-base insert and an aluminum-base cast member as recited in claim 16 further comprising the step of cooling said molten aluminum-base casting material and said coated insert within said mold so as to form a composite aluminum alloy casting.

19. A method for forming a metallurgical bond between an aluminum-base insert and an aluminum-base cast member as recited in claim 16 wherein said aluminum-base insert is selected from the group consisting of wrought aluminum alloys, castable aluminum alloys, and aluminum-base metal-matrix composites.

20. A method for forming a metallurgical bond between an aluminum-base insert and an aluminum-base cast member as recited in claim 16 wherein said magnesium in said molten zinc-base alloy reacts with oxygen and aluminum oxide to form magnesium oxide or spinel while said aluminum-base insert is immersed in said molten zinc-base alloy.

* * * * *